United States Patent [19]

Samejima et al.

[11] Patent Number: 4,539,083

[45] Date of Patent: Sep. 3, 1985

[54] METHOD FOR PREVENTING DEGRADATION IN ACTIVITY OF A LOW HYDROGEN OVERVOLTAGE CATHODE

[75] Inventors: Yasushi Samejima, Kakogawa; Minoru Shiga, Himeji; Toshiji Kano; Takamichi Kishi, both of Kakogawa, all of Japan

[73] Assignee: Kanegafuchi Kagaku Kogyo Kabushiki Kaisha, Osaka, Japan

[21] Appl. No.: 634,523

[22] Filed: Jul. 26, 1984

[30] Foreign Application Priority Data

Jul. 26, 1983 [JP] Japan ..... 58-136091

[51] Int. Cl.[3] ..... C25B 1/16; C25B 1/26

[52] U.S. Cl. ..... 204/98; 204/128

[58] Field of Search ..... 204/98, 128

[56] References Cited

U.S. PATENT DOCUMENTS

| | | | |
|---|---|---|---|
| 4,169,775 | 10/1979 | Kuo | 204/98 |
| 4,333,804 | 6/1982 | Saito et al. | 204/98 |
| 4,379,035 | 4/1983 | Chamberlin | 204/98 |

FOREIGN PATENT DOCUMENTS

| | | | |
|---|---|---|---|
| 0035895 | 3/1979 | Japan | 204/98 |

*Primary Examiner*—Howard S. Williams
*Assistant Examiner*—Terryence Chapman
*Attorney, Agent, or Firm*—Armstrong, Nikaido, Marmelstein & Kubovcik

[57] ABSTRACT

Disclosed is a method for preventing a low hydrogen overvoltage cathode from degradation in activity characterized by adding a reducing agent to a cathode compartment of an electrolytic cell which electrolysis an aqueous alkali metal halide solution. According to the invention, no degradation takes place even after repeated shutdown of operation.

5 Claims, No Drawings

METHOD FOR PREVENTING DEGRADATION IN ACTIVITY OF A LOW HYDROGEN OVERVOLTAGE CATHODE

BACKGROUND OF THE INVENTION

1. Field of the Invention

The present invention generally relates to an electrolysis process of an aqueous alkali metal halide solution using an asbestos diaphragm or an ion exchange membrane, more specifically, to a process for preventing a low hydrogen overvoltage cathode from degrading in activity at the time of shutdown of an electrolytic cell for use in the foregoing electrolysis.

2. Description of Prior Art

As electrolysis processes of an aqueous alkali metal chloride solution, a mercury electrolysis process and an asbestos diaphragm process have been practiced on an industrial scale. However, the former is being switched to the latter because of environmental pollution. The asbestos diaphragm process, notwithstanding, has numerous disadvantages including low quality product and great consumption of energy, so that an ion exchange membrane electrolysis process has been developed. It is surmised that in the near future alkali hydroxide will be produced by the asbestos diaphragm electrolysis process and the ion exchange membrane electrolysis process in Japan.

The asbestos diaphragm electrolytic cell and the ion exchange membrane electrolytic cell involve two different systems of monopolar type and bipolar type, and mild steel has been heretofore served as a cathode in every type. Hydrogen overvoltage of mild steel, nontheless, is as high as 0.3 to 0.4 Volt and thus the study on low hydrogen overvoltage cathodes to save energy cost is being actively made. For example, a variety of processes including plating or spraying of nickel or a nickel alloy are proposed by Japanese Patent Non-examined Publication Nos. 112785/79, 63686/82, 82483/82, 114678/82 and the like.

However, it has been pointed out that when a low hydrogen overvoltage cathode prepared by those techniques is installed to the asbestos diaphragm or the ion exchange membrane electrolytic cell, activity of the cathode deteriorates to thus result in an increase in hydrogen overvoltage. The phenomenon appears notoriously when the operation of the specified electrolytic cell under operation was shut down for reasons of inspection, changing of the asbestos diaphragm or ion exchange membrane, exchange of electrodes and so on.

As a rule, the operation of the specified electrolytic cell among a plurality of electrolytic cells under operation is shut down by the use of a short-circuit switch. In such a case, to the electrolytic cell shut down an electric current reverse to the original electrolytic current begins to flow instantaneously when short-circuited. Then, a cathode becomes to be an anode and dissolution of metal occurs. The dissolution of the metal presumably occurs selectively from high active portions and the activity before shutdown is no longer expected even when the operation is resumed. As the result, cell voltage increases.

SUMMARY OF THE INVENTION

It is therefore an object of the present invention to provide a method of preventing degradation in activity of a low hydrogen overvoltage cathode.

Other objects of the present invention together with advantages thereof will become apparent to those skilled in the art from the detailed disclosure of the present invention as set forth hereinbelow.

Through an extensive series of studies by the present inventors on the problem of degradation in activity of the low hydrogen overvoltage cathode at the time of shutdown, it has been found out that the foregoing objects can be achieved by adding a reducing agent to a cathode compartment of an electrolytic cell at the time of shutdown, thus the present invention having been completed.

DETAILED DESCRIPTION OF THE INVENTION

The present invention encompasses a method for preventing degradation in activity of a low hydrogen overvoltage cathode, which comprises adding a reducing agent at the time of shutdown to a cathode compartment of an electrolytic cell for use in an aqueous alkali metal halide solution which is partitioned by an asbestos diaphragm or an ion exchange membrane into an anode compartment and a cathode compartment and is equipped with a low hydrogen overvoltage cathode.

Investigations have yet to be made to fully clarify the mechanism of the present invention. Presumably the prevention of degradation in activity of the low hydrogen overvoltage cathode is attributable to the following mechanism. Explanation will be made as to an example in which caustic soda is prepared by electrolysing sodium chloride with a porous nickel metal served as an active cathode.

When operation is shut down, the following reaction presumably takes place on the surface of the low hydrogen overvoltage cathode of the electrolytic cell;

$$H_2 \rightarrow 2H^+ + 2e^- \quad (1)$$

$$Ni + 3OH^- \rightarrow HNiO_2^- + H_2O + 2e^- \quad (2).$$

The reaction (1) is one in which hydrogen absorbed on the low hydrogen overvoltage cathode is oxydized, having no connection with the dissolution of metal. After the absorbed hydrogen is consumed by the reaction (1), the reaction (2) takes place to cause the dissolution of metal to commence. Electric potential of this reaction is shown by the following equation;

$$E = -0.593 - \frac{0.059}{2} \log \frac{(OH^-)^3}{(HNiO_2^-)} \text{ (at 25°C.)}$$

That is, though reactive electric potential E is variable according to the concentration of caustic soda and the ion concentration of nickel, when $[OH^-]$ is 10 mol/l and $[HNiO_2^-]$ is $10^{-6}$ mol/l, the reactive electric potential is $-0.859$ Volt. Accordingly, the presence of a reducing agent having oxidation-reduction potential smaller than $-0.859$ Volt in caustic soda in the cathode compartment permits oxidation of the reducing agent to occur before the reaction (2), whereby the dissolution of nickel is prevented to thus avoid degradation in activity of the cathode.

The reducing agent usable in the present invention may include inorganic salts such as sulfites, phosphites, hypophosphites, dithionites and pyrosulfites. These are used singly or in combination of two or more, but a salt of the same alkali metal as that of an alkali metal hydroxide produced is preferred to use, taking into consideration an influence on the quality of the product.

A method for adding the reducing agent to the cathode compartment is not limited in particular, various processes being employed. For the ion exchange membrane electrolysis, addition of the reducing agent may be made by adding in the form of an aqueous solution or solid to a storage tank provided in an aqueous alkali metal hydroxide liquor-circulating line, a water-supply line provided to the cathode compartment, or any other manners. For the asbestos diaphragm electrolysis, it is preferred to provide a reducing agent aqueous solution-supply line to the cathode compartment through which it is supplied. Addition may be achieved either continuously or intermittently. The concentration of the reducing agent aqueous solution, though not specifically limited, should preferably be lower than that in which the reducing agent does not precipitate owing to mutual solubility of three-component system i.e., alkali metal hydroxide-reducing agent-water. In the case of higher than the foregoing range, the reducing agent precipitates to plug an adding inlet of the cathode compartment, which makes it impossible to supply the reducing agent in an amount desired.

An amount of the reducing agent added is variable according to the type of the electrolytic cells but should preferably be between 0.01 equivalent and 100 equivalents, more preferably between 0.1 equivalent and 50 equivalents per square meter of the effective area of the low hydrogen overvoltage cathode. In the case of smaller than 0.01 equivalent, no adequate effects of preventing degradation in activity are expected, while an amount exceeding 100 equivalents does not lead to an increase in effects, but to uselessness. The word "equivalent" used in the invention means a chemical equivalent per mole of the reducing agent required enough to change anion of the reducing agent added to the form of ion which is no longer reactive with oxygen in the aqueous solution. For sulfites and phosphites, one mole corresponds to two equivalents, and one mole is four equivalents for hypophosphites and pyrosulfites, and for dithionites one mole is six equivalents.

The reducing agent may be added before shutdown, simultaneously therewith, or several minutes or ten and several minutes thereafter, but, to obtain the best results, should be added beforehand to the cathode compartment immediately before shutdown of the electrolytic cell under operating. After addition, operation is shut down by a short-circuit device and a busbar had better be cut off as rapidly as possible on either plus or minus side of the cell. By cutting off of the busbar, a reverse electric current circuit formed between the shutdown cell and the short-circuit device is broken to thus impede the reverse electric current. Moreover, although an electrolysis equipment is generally comprised to 20 to 200 electrolytic cells electrically connected in series or in parallel, the present invention is specifically effective to the case where the specific one or two or more are shut down individually, though, of course, effective to the shutdown of all cells. The economical method for prevention of degradation of cathode activity has never been proposed by the prior arts but has been attained for the first time by the present invention.

The present invention will be explained in more detail by way of Examples and a Comparative Example that follow, to which the invention is in no manner limited.

EXAMPLE 1

A mild steel plate, 90 mm in length, 40 mm in width and 2 mm in thickness was subjected to chemical plating with nickel in the thickness of 30 μm. Next, Raney-nickel particles comprising 50 weight % Al, 45 weight % Ni and 5 weight % Ru were dispersed in a nickel plating bath with which one side of the nickel-plated mild steel plate was codeposit plated in the thickness of 250 μm. The codeposit plated mild steel plate thus obtained, having content of 30 weight % Raney-nickel in the plating thin layer, was immersed in a 20 weight % aqueous caustic soda solution at 50° C. for 2 hours to thus obtain a low hydrogen overvoltage cathode.

From "NAFION 901" cation exchange membrane manufactured and sold by E. I. Du Pont de Nemours & Company, an expanded titanium thin plate anode coated with $TiO_2$ and $RuO_2$, and the foregoing low hydrogen overvoltage cathode, a monopolar type eleactrolytic cell was fabricated, by which sodium chloride was electrolysed. Operation was carried out while controlling current density to 23.5 A/d $m^2$, the temperature to 90° C., anolyte NaCl concentration to 210 g/l and NaOH concentration to 32 weight%. Current efficiency was 96%, cell voltage was 3.18 Volts and hydrogen overvoltage was 0.07 Volt.

After the NaOH concentration in the cathode compartment was diluted to 22 weight %, a 0.5 mol/l aqueous sodium sulfite ($Na_2SO_3$) solution was added to the cathode compartment in an amount of 20 equivalents per square meter of the cathode and operation was shut down immediately thereafter by short-circuit device. After 15 minutes, electric power was supplied again and the NaOH concentration was returned to 32 weight %. Then operation was continued for one hour and shut down similarly. Thereafter operation of the cell and shutdown were repeated 20 times similarly. Current efficiency of 96%, cell voltage of 3.18 Volts and the cathode hydrogen overvoltage of 0.07 Volt were retained after above procedure. No degradation in activity of the cathode resulting from shutdown was observed.

EXAMPLE 2

An experiment was carried out in a similar fashion to that of Example 1 with an exception that an aqueous sodium dithionite ($Na_2S_2O_4$) solution was employed in place of an aqueous sodium sulfite solution. With the NaOH concentration being kept to 32 weight %, the aqueous solution containing 0.15 mol/l of sodium dithionite was added to the cathode compartment in an amount of 5 equivalents per square meter of the cathode, then the operation was shut down rapidly by the short-circuit device. After 15 minutes, supply of electric power was resumed. Operation was continued for one hour and then shut down. Thereafter shutdown was repeated 20 times similarly and followed by operation again. After resumption, current efficiency was 96%, cell voltage was 3.18 Volts and hydrogen overvoltage was 0.07 Volt. There was observed no degradation in activity of the cathode even after the shutdown.

EXAMPLE 3

An experiment was performed in a similar fashion to that of Example 1, excepting that an aqueous sodium sulfite solution was substituted with an aqueous sodium hypophosphite ($Na_2HPO_2$) solution. With the NaOH concentration of 32 weight % unchanged, the aqueous solution containing 0.25 mol/l of sodium hypophosphite was added to the cathode compartment in an amount of 10 equivalents per square meter of the cathode, thereafter the operation was shut down immediately by the short-circuit device. After 15 minutes, electric power was supplied again and the operation was continued for one hour, then shut down similarly. Thereafter the operation was shut down 20 times by the short-circuit switch in a similar manner but hydrogen overvoltage was 0.07 Volt, which showed no degradation in activity of the cathode.

COMPARATIVE EXAMPLE 1

An experiment was conducted similarly to Example 1, excepting that a reducing agent was not added. Current efficiency was 96%, cell voltage was 3.33 Volts and hydrogen overvoltage of the cathode was 0.22 Volt. The results showed degradation in activity of the cathode caused by shutdown took place.

What we claim is:

1. A method of preventing degradation in activity of a low hydrogen overvoltage cathode in an electrolytic cell in the electrolysis of an aqueous alkali metal halide, said electrolytic cell being partitioned by an asbestos diaphragm or an ion exchange membrane into an anode compartment containing an anolyte and a cathode compartment containing a catholyte and being equipped with a low hydrogen overvoltage cathode, said method comprising adding a reducing agent to said catholyte during shutdown of the cell.

2. The method of claim 1, wherein the reducing agent is selected from the group consisting of sulfites, phosphites, hypophosphites, dithionite, pyrosulfites and mixtures thereof.

3. The method of claim 1, wherein the reducing agent is added in an amount of from 0.01 equivalent to 100 equivalents per square meter of the effective area of the low hydrogen overvoltage cathode.

4. The method of claim 1, wherein the reducing agent is added to the cathode compartment, then operation of the cell is shut down.

5. The method of claim 1, wherein said electrolytic cell is one of a plurality of electrolytic cells connected in series or in parallel in the electrolysis of said aqueous alkali metal halide.

* * * * *